United States Patent [19]

Oepping et al.

[11] 4,368,559

[45] Jan. 18, 1983

[54] FURNITURE HINGE

[75] Inventors: Wilfried Oepping, Kirchlengern; Ulrich Beneke, Bünde, both of Fed. Rep. of Germany

[73] Assignee: Paul Hettich & Co., Kirchlengern, Fed. Rep. of Germany

[21] Appl. No.: 162,731

[22] Filed: Jun. 25, 1980

[30] Foreign Application Priority Data

Jun. 30, 1979 [DE] Fed. Rep. of Germany ..... 2926486

[51] Int. Cl.[3] ..... E05D 5/10

[52] U.S. Cl. ..... 16/386; 16/379

[58] Field of Search ..... 16/157, 163, 164, 386, 16/366, 379, 291, 287, 294

[56] References Cited

U.S. PATENT DOCUMENTS 3,001,224 9/1961 Soss ..... 16/164
3,590,420 7/1971 Salice ..... 16/164

FOREIGN PATENT DOCUMENTS 1285913 12/1968 Fed. Rep. of Germany ..... 16/386
1168852 10/1969 United Kingdom ..... 16/164

*Primary Examiner*—Louis Rimrodt
*Assistant Examiner*—Andrew M. Falik
*Attorney, Agent, or Firm*—Michael J. Striker

[57] ABSTRACT

A furniture hinge has a hollow housing connectable with one part of furniture, a hinge arm connectable with another part of furniture, at least two links extending between and pivotally connecting the hinge arm with the housing of which one link is pivotal relative to the housing, and at least two link pins each having a curved portion and a straight portion wherein the curved portions of the link pins support the one link for pivoting relative to the housing, and the straight portions of the link pins extend through the interior of the housing.

8 Claims, 4 Drawing Figures

FURNITURE HINGE

BACKGROUND OF THE INVENTION

The present invention relates to a furniture hinge. More particularly, it relates to a furniture hinge which has a cup-shaped housing insertable in a recess of one furniture part and a hinge arm connectable to another furniture part.

Furniture hinges of the above-mentioned general type are known in the art. In a known furniture hinge, shackles or links are provided between the housing and the hinge arm, and one of the links is pivotally mounted on a pivot which is arrested in the housing and projects from a wall of the housing into the interior of the latter. The furniture hinge having the above-described construction encounters some difficulties in pivotal mounting of the pins in the region of the cup-shaped housing in the cases when the walls of the housing have low carrying capacity. The housing can have the low carrying capacity because it is composed of synthetic plastic material or because it is manufactured by a deformation process. When the housing is constituted of metal and manufactured, for example, by deep drawing, the walls of the housing in the region of hinge links which connect the housing with the hinge arm, are very thin. Thereby, these walls cannot provide for sufficient support for the straight link pins or pivots extending from the wall into the interior of the housing.

SUMMARY OF THE INVENTION

Accordingly, it is an object of the present invention to provide a furniture hinge which avoids the disadvantages of the prior art.

More particularly, it is an object of the present invention to provide a furniture hinge which is designed so as to insure that hinge links in the region of housing of the furniture hinge are provided with a support having high carrying capacity.

In keeping with these objects and with others which will become apparent hereinafter, one feature of the present invention resides, briefly stated, in a furniture hinge in which two hinge links are supported by two link pins each having a curved portion and a straight portion, wherein the curved portions of the link pins pivotally support one of the links and whereas the straight portions of the link pins extend through the interior of the housing.

When the furniture hinge is designed in accordance with the present invention, the link pins are utilized for forming pivot axes for the hinge links in the region of the housing and formed as shaped members provided with a straight portion and a curved portion. They are so arranged in the housing, that they extend three times through a wall of the housing. The link pins can be loaded either by applying a load exclusively to the pivot which is formed by free ends of the curved portions of the link pins, or by loading both the above-mentioned pivots and the straight portions of the link pins. In both cases, the load is transmitted from the link pins to the housing at the above-mentioned three locations.

The novel teachings which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
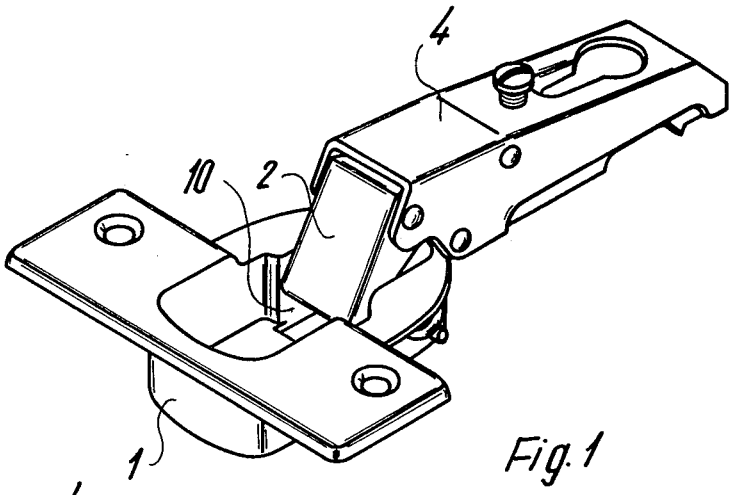
FIG. 1 is a perspective view showing a furniture hinge in accordance with the present invention.
Figure 2:
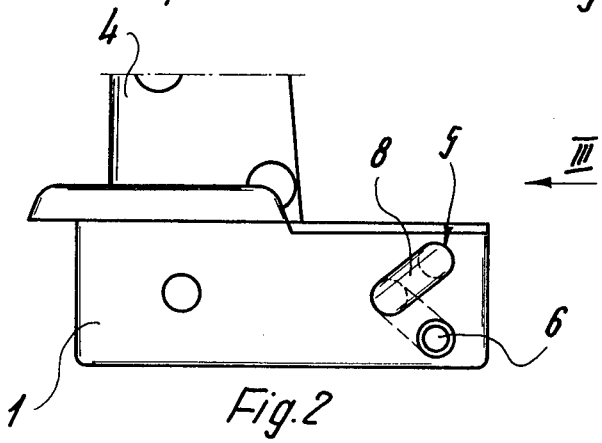
FIG. 2 is a side view of the furniture hinge of FIG. 1, in closed position.

A furniture hinge in accordance with the present invention has a hollow housing 1 which may be cup-shaped. The housing 1 may be constituted of metal and manufactured by a deep drawing process. The housing 1 may also be constituted of synthetic plastic material.

The furniture hinge has a hinge arm 4. The hinge arm 4 is pivotally connected with the housing 1 by hinge links 2,3. The hinge link 3 in the shown example is composed for four lamellas.

The links 2,3 in the region of the housing 1 have pivot axes which are formed by link pins 5,6. The link pins 5 and 6 are supported in the housing 1 with press fit. Each link pin 5,6 has a straight portion 7 and a curved or arcuate portion 8. Each of the curved portions 8 has a free end which forms a pivot 9 extending into an inner hollow 10 of the housing 1.

Both pivots 9 of the link pins 5,6 together define a pivot axis for the link 2. A free space remains between the pins 9, and the link 3 extends in this free space in different positions of the hinge.

Figure 3:
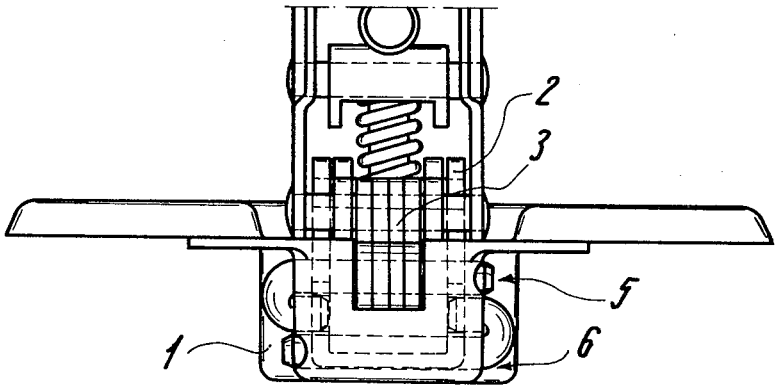
FIG. 3 is a plain view in direction of the arrow III in FIG. 2.
Figure 4:
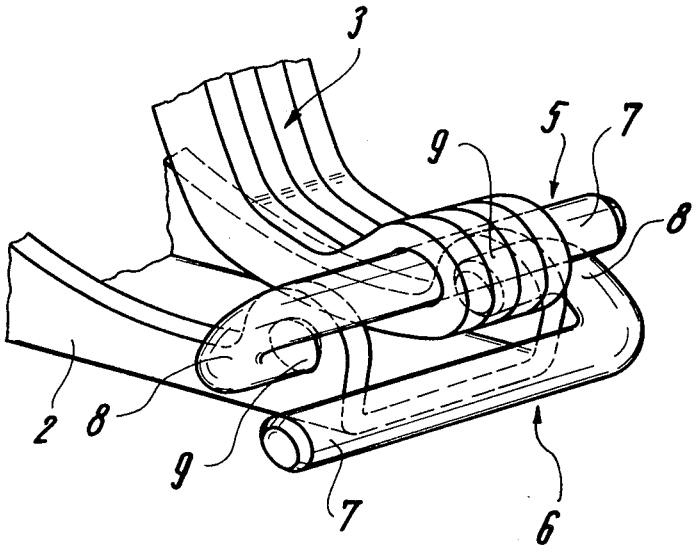
FIG. 4 is a perspective view of some parts of the inventive furniture hinge.

As can be seen particularly from FIGS. 3 and 4, the straight portion 7 of the link pin 5 forms a pivot axis for the link 3 in the region of the housing. The free ends of pivots 9 of the curved portions 8 of the link pins 5,6 extend into the interior of the housing, the remainder sections of the curved portions 8 extend outwardly of the housing 1.

As can be seen from FIG. 3, the link pins 5,6 extend through the walls of the housing 1 at three locations or points. Thereby, when the link pins are loaded, effective transmission of force from the link pins to the housing 1 is attained.

As can be seen from the drawings, the straight portion 7 of the link pin 6 extends between an end wall of the housing, which faces toward the hinge arm, and an end wall of the link 2.

It will be understood that each of the elements described above, or two or more together, may also find a useful application in other types of constructions differing from the types described above.

While the invention has been illustrated and described as embodied in a furniture hinge, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A furniture hinge, comprising a hollow housing connectable with one part of furniture; a hinge arm connectable with another part of furniture; at least two links extending between and pivotally connecting said hinge arm with said housing; and at least two link pins each having a curved portion and a straight portion, said curved portions of said link pins pivotally supporting one of said links, and said straight portions of said link pins extending through the interior of said housing.

2. A furniture hinge as defined in claim 1, wherein said housing is cup-shaped and insertable into a recess of the one part of furniture.

3. A furniture hinge as defined in claim 1, wherein the curved portion of one of said link pins has a free end section which somewhat extends into said housing and pivotally supports said one link, whereas the straight portion of said one link pin supports the other of said links.

4. A furniture hinge as defined in claim 3, wherein said straight portion of said one link pin is fixedly mounted in said housing.

5. A furniture hinge as defined in claim 3, wherein said links extend over a predetermined region, the straight portion of the other of said link pins extending outwardly beyond said region of said links.

6. A furniture hinge as defined in claim 5, wherein said straight portion of said other link pin is fixedly mounted in said housing.

7. A furniture hinge as defined in claim 5, wherein the curved portion of said other link pin has a free end section which somewhat extends into said housing and pivotally supports said one link.

8. A furniture hinge as defined in claim 7, wherein said curved portion of each of said link pins has a remainder section which extends outwardly of said housing.

* * * * *